US005749108A

United States Patent [19]

Barnett

[11] Patent Number: 5,749,108

[45] Date of Patent: May 12, 1998

[54] SPRING TO METAL RAIL ASSEMBLY

[75] Inventor: Clayton M. Barnett, Frankfort, Ky.

[73] Assignee: L&P Property Management Co., South Gate, Calif.

[21] Appl. No.: 889,946

[22] Filed: Jul. 10, 1997

[51] Int. Cl.[6] ..... A47C 23/00; A47C 23/02

[52] U.S. Cl. ..... 5/264.1; 5/247; 267/103

[58] Field of Search ..... 5/264.1, 263, 265, 5/247, 255; 267/103, 100, 106, 107; 29/91.1

[56] References Cited

U.S. PATENT DOCUMENTS

| | | | |
|---|---|---|---|
| 259,192 | 6/1882 | Mock | 5/264.1 |
| 1,124,031 | 1/1915 | Kohler | 5/264.1 |
| 2,773,271 | 12/1956 | Wetzler | 5/264.1 |
| 3,680,157 | 8/1972 | Slominski et al. | 5/247 |
| 3,750,201 | 8/1973 | Usami | 5/263 |
| 3,971,081 | 7/1976 | Roe | 5/263 |
| 4,218,790 | 8/1980 | Mizelle | 5/247 |
| 4,592,106 | 6/1986 | Hagemeister | 5/245 |
| 4,779,292 | 10/1988 | Dabney | 5/264.1 |
| 4,861,002 | 8/1989 | Dabney | 5/264.1 |
| 4,921,228 | 5/1990 | Lowe | 5/247 |
| 5,054,751 | 10/1991 | Brown | 267/100 |
| 5,519,903 | 5/1996 | Constantinescu | 5/264.1 |

*Primary Examiner*—Alexander Grosz
*Attorney, Agent, or Firm*—Wood, Herron & Evans, L.L.P.

[57] ABSTRACT

A spring assembly comprising a frame, a plurality of metal rails secured to the frame and a plurality of spaced spring modules secured to the rails. Each of the rails comprises a top portion and two sidewalls extending downwardly from the top portion and terminating in outwardly extending flanges. The sidewalls define a throat proximate the flanges. The spring module has at least one mounting foot comprising two opposed leg portions joined together by a connecting portion, each of the leg portions having a notch therein for engagement with a slot in the planar upper portion of the rail. The connection portion of the mounting foot is engagable with the throat defined by the sidewalls of the rail so as to inhibit lateral movement of the mounting foot within the rail.

22 Claims, 4 Drawing Sheets

SPRING TO METAL RAIL ASSEMBLY

BACKGROUND OF THE INVENTION

This invention relates to support rails used in spring assemblies such as bedding foundations, seat assemblies and the like and to springs having a lower portion adapted to be held in a snap-fit locked position inside the support rails.

DESCRIPTION OF THE PRIOR ART

Generally, a box spring assembly includes a rectangularly shaped and horizontally positioned frame above which is supported a mattress support deck. A plurality of spring modules are interposed between the frame and the deck to support a load distributed along the deck. At their upper ends, the spring modules include deck attaching portions which interact with the deck so as to attach the modules to the deck. At their lower ends, the spring modules typically have either one or a pair of mounting feet for attachment to rails which extend either longitudinally of the frame or transversely across the frame. A grid-like network of deck wires and a generally rectangular border wire comprises the deck. The deck wires extend both longitudinally and transversely between and are attached to the border wire. The spring modules yieldably support the deck a pre-determined distance above the frame.

Most often, the frame itself is formed of wood and has a perimeter comprising two side members and two end members. Spaced rails may extend transversely across the width of the frame or longitudinally along the length of the frame and are formed out of either metal or wood. Depending on the type of rail, the mounting feet of the springs are secured to the rails by various methods. If the rails are wooden, the mounting feet of the springs are generally stapled in place on the rails. If the rails are constructed of metal, the rails typically have an inverted U-shaped cross-section and a substantially horizontal top and two substantially vertical sidewalls. The mounting feet of the springs to be secured to the metal rails are typically horizontally oriented U-shaped wires which are inserted into slots formed in the sidewalls of the rails.

Several patents such as U.S. Pat. Nos. 4,218,790; 4,861,002; and 4,779,292 disclose spring modules having one or more generally horizontally oriented lower or foot portions adapted to be inserted and held inside a metallic rail. These metallic rails have an inverted U-shaped cross-section with a generally horizontal flat upper portion and two sidewalls extending downwardly from the upper portion of the rail. Slots are punched in the two sidewalls at spaced locations in order to accept the mounting feet of the spring modules. The mounting feet of the spring modules each typically comprises a generally U-shaped wire which is compressed and then inserted into one of the slots of the sidewalls of the rails. When the compression is released the legs of the U-shaped wire move outwardly causing a friction fit of the foot portion within a slot of the rail holding the spring module to the rail. U.S. Pat. Nos. 4,861,002 and 4,779,292 both disclose spring modules having two mounting feet both inserted into a metallic rail through horizontally oriented slots in the sidewalls of the rail. This type of connection between a metallic rail having slotted sidewalls and a horizontally oriented foot portion of a spring module requires that the rail sidewalls be slotted and the mounting feet of the spring modules be U-shaped wires.

U.S. Pat. No. 5,176,367 discloses spring modules each having a vertically oriented mounting foot secured to a wooden slat with the use of one or more staples. The use of staples to secure a substantially vertically oriented foot portion of a spring module to a crossing slat or rail works fine if the rail is made of wood but if the rail is made of metal, this type of attachment will not work. U.S. Pat. No. 1,124,031 does disclose a spring having a substantially vertically oriented lower mounting portion 10 inserted into a metallic rail, the metallic rail having a series of slots therein. This type of attachment is fine but does not lock the spring to the rail. By simply lifting the spring upwardly, the spring can separate from the rail.

It has been one objective of the present invention to provide a spring assembly having a plurality of spring modules, each spring module having at least one vertically oriented mounting foot which may be easily and conveniently lockingly secured to a metal rail and held therein.

It has been a further objective of the present invention to provide a metallic rail adapted to receive and hold therein a vertically oriented mounting foot of a spring module.

It has further been an objective of the present invention to provide a spring module having a vertically oriented mounting foot which may be compressed, passed through a slot in a top portion of a metallic rail and released into a snap-fit locked position in which the spring module is securely united with the metal rail.

SUMMARY OF THE INVENTION

The invention of this application which accomplishes these objectives comprises a spring assembly having a frame, a plurality of metal rails secured to the frame and a plurality of spaced spring modules secured to the rails. The frame is generally rectangular having two end pieces and top opposed side pieces usually made of wood. The rails of the present invention are metallic and may extend transversely from one side member of the frame to the other side member of the frame or may extend longitudinally of the frame from one end member of the frame to the other end member of the frame. Each of the rails has a cross-section comprising a horizontal top portion, two opposed sidewalls extending downwardly from the top portion and a bottom portion comprising two outwardly extending planar flanges. Each of the sidewalls has a bottom portion defining a lower throat between the sidewalls proximate the planar flanges of the rail at the location where the sidewalls are closest together. The rails are secured to the frame by conventional fasteners such as nails or screws passing through the planar flanges of the rails at the ends of the rails. The top portion of each rail has a plurality of longitudinally extending spaced slots therein which extend through the top portion of the rail. Each slot comprises a middle portion and two closed end portions. The closed end portions may be of a width less than the 6 width of the middle portion of the slot to facilitate insertion of a spring module into the slot. Alternatively, each slot may be of uniform width throughout its length, the closed end portions being the same width as the middle portion of the slot.

A plurality of spring modules are secured to the rails and are spaced along the lengths of the rails at the locations of the slots in the top portions of the rails. Each of the spring modules has an upright yieldable portion which typically comprises two legs but may take on a variety of different configurations in accordance with this invention and a generally vertically oriented U-shaped or V-shaped (hereinafter referred to collectively as U-shaped) mounting foot located at the lower end of the upright portion. Each spring module may be supported on the rail by at least one mounting foot, each mounting foot being insertable and held in a slot.

Each mounting foot comprises a pair of spaced leg portions joined together by a connecting portion urging the leg portions apart. Each leg portion has an inwardly curved notch or detent at the upper end thereof for engaging a closed end portion of a slot in order to retain the mounting foot in the slot. In order to further hold and retain the mounting foot of a spring module in a slot, the sidewalls of the rail are configured so that the throat defined between the sidewalls is sized so as to engage the connecting portion of the mounting foot in an interference fit and thereby prevent any lateral movement of the mounting foot while inside the interior of the rail. The depth of the mounting foot is such that the connecting portion of the foot does not extend below the flanges of the rail when the notches of the leg portions are engaged with the closed end portions of the slots.

This unique configuration of a generally hollow metallic rail having two converging sidewalls proximate the bottom of the rail enables the rail to engage a vertically oriented mounting foot of a spring module at two different vertical locations: 1) at the lowermost location of the spring module, the connecting portion of the mounting foot and 2) at the top of the leg portions where the notches or detents are located. This capability of the rail to engage and hold stationary two different portions of a mounting foot of a spring module increases the strength and stability of the connection between the spring module and the metallic rail.

In order to connect the spring module to the rail the lowermost mounting foot of the spring module is pressed downwardly through a longitudinally extending slot in the rail until the notches of the leg portions of the mounting foot engage a closed end portion of the slot. The inward curve of the notches or detents prevents the mounting foot from moving vertically up and down and being easily removed from the rail. Further, when the mounting foot is pushed downwardly through a slot sufficiently far enough so that the connecting portion of the mounting foot engages the lower throat of the rail, the mounting foot is inhibited from moving laterally.

In order to remove the spring module from the rail, all one needs to do is to compress the two leg portions of the mounting foot disengaging the notches or detents of the leg portions of the mounting foot with the closed end portions of the rail slot. This compression should occur while the spring module is being pulled upwardly away from the rail. Once the detents are not engaged with the closed end portions of the slots, a slight upwardly directed force is sufficient to pull the spring module up and away from the rail.

The upper portion of each spring module is connected to a substantially planar upper deck. The upper deck comprises a generally rectangular border wire and criss-crossing wire deck members extending both longitudinally and transversely forming a grid type structure. The ends of the deck members are secured to the border wire. The upper portion of each spring module is secured to the deck by mechanical fasteners, crimps formed in the deck members, crimps formed in the upper portions of the spring modules, welds, chemical bonding, interlocking such as is disclosed in U.S. Pat. No. 4,921,228 or any other type of mechanical fastener.

This type of rail and vertically oriented mounting foot of a spring module provide a strong interference fit connection between the spring module and the rails of the frame of a spring assembly. The configuration of the mounting feet of the spring modules enables the spring modules to be snapped into a locked position in which they are secured firmly in the rails yet may be removed by squeezing together the two legs of the upright yieldable portion of the spring module. Regarding the rail itself, the converging sidewalls of the throat of the rail provide an additional engagement of the mounting foot with the rail inhibiting lateral movement of the spring module. The connection between the rail and mounting foot of the spring module of the present invention increases the stability of the upright yieldable portion of the spring modules and hence the stability of the spring assembly as a whole.

These and other objects and advantages of this invention will become more readily apparent from the following description of the drawings in which:

DESCRIPTION OF THE PREFERRED EMBODIMENT

Figure 1:
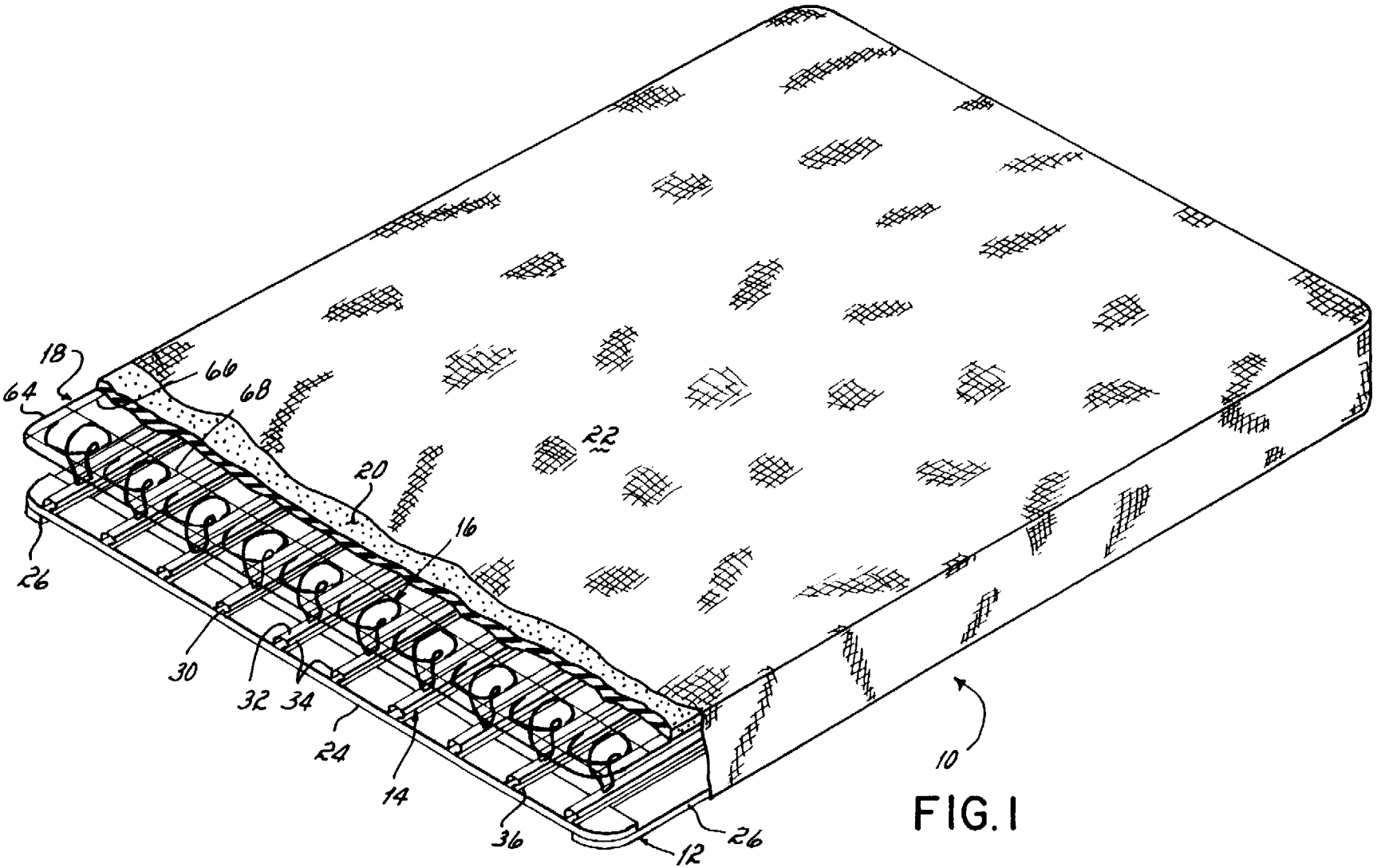
FIG. 1 is a perspective view, partially broken away of a bedding foundation incorporating the invention of this application.

Referring to the drawings and particularly to FIG. 1, there is illustrated a bedding foundation 10 comprising a generally rectangular frame 12, a plurality of rails 14 secured to the frame, a 11, plurality of springs modules 16 secured to the rails 14, a deck 18 secured to the upper portions of the spring modules 16, a mattress pad 20 and an upholstered covering 22. Although FIG. 1 illustrates a bedding foundation, the present invention may be used in automotive seating, furniture and various other applications.

Figure 2:
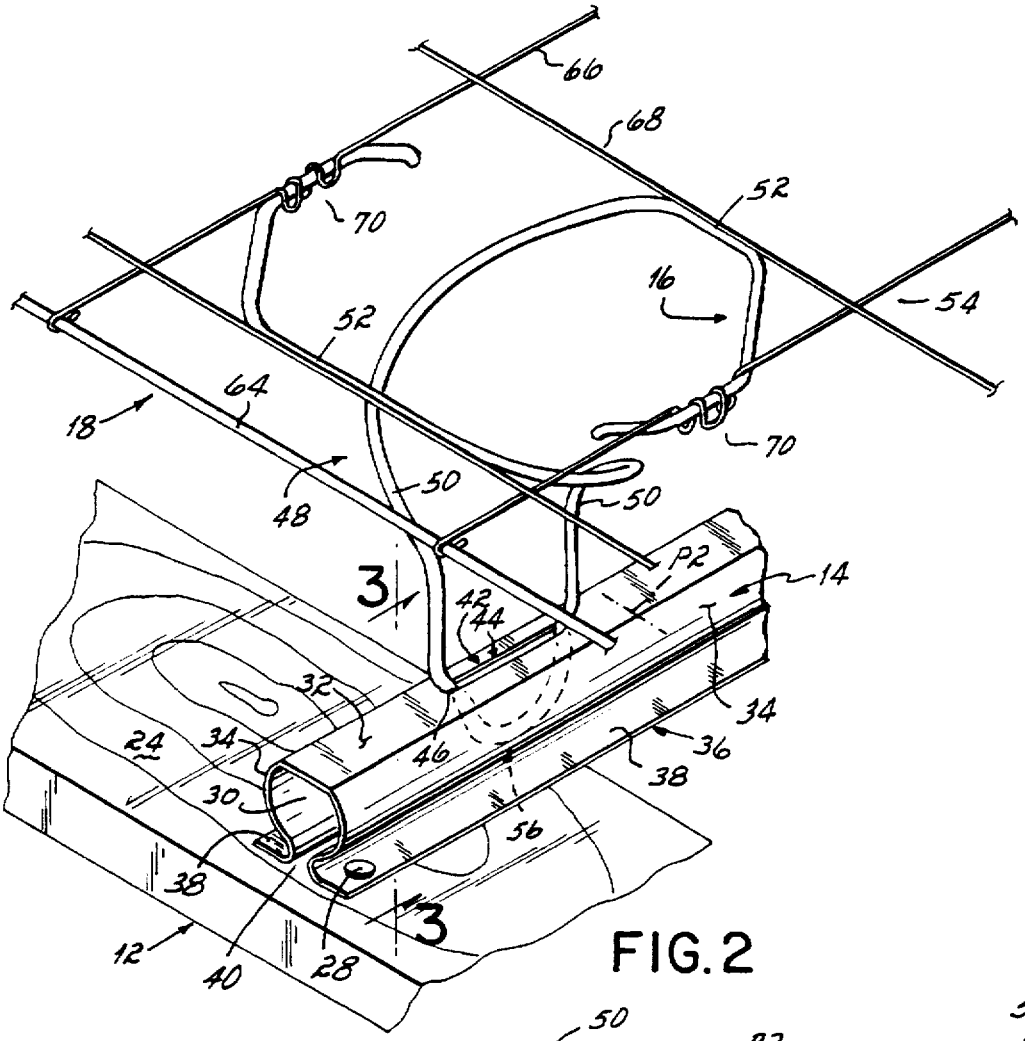
FIG. 2 is a perspective view of a rail of the present invention secured to a frame member and a spring module lockingly engaged with the rail.

If the present invention is used in a bedding application as illustrated in FIG. 1, the frame is generally rectangular having two end pieces 24 and two side pieces 26. The rails 14 may extend longitudinally of the frame from one end piece 24 to the other end piece (not shown) of the frame as illustrated in FIGS. 1 and 2; or, alternatively, the rails 14 may extend transversely of the frame from one side piece 26 of the frame to the other side piece 26 of the frame. The rails of the present invention are made of metal and are secured to the frame 12 with one or more securements 28 which may be nails, screws or any other conventional fasteners. Usually the frame is made of wood but may be made of any material.

Figure 3:
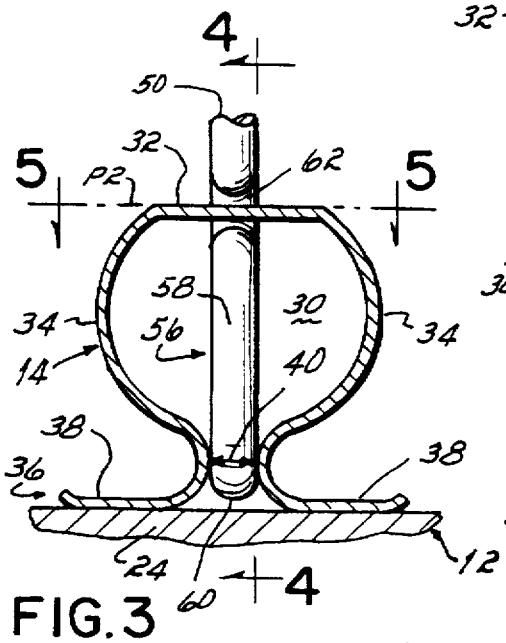
FIG. 3 is a cross-sectional view taken along the lines 3—3 of FIG. 2.
Figure 5:
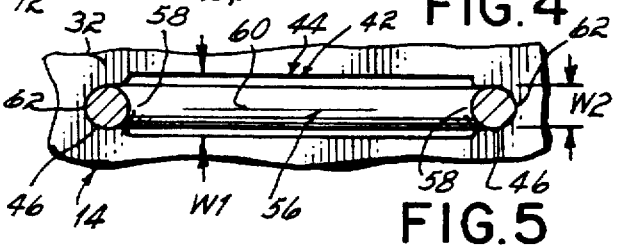
FIG. 5 is a cross-sectional view taken along the lines 5—5 of FIG. 3.

As illustrated in FIG. 3, each of the rails 14 may have a generally bulbous cross-section, a hollow interior 30, a substantially planar horizontal top portion 32, two opposed outwardly bowed sidewalls 34 extending downwardly from the top portion 32 and a bottom portion 36 comprising two outwardly extending flanges 38. The sidewalls 34 may be arcuate, bowing away from each other as they extend downwardly from the top portion 32 until approximately half way down the sidewalls 34 at which point the sidewalls 34 curve inwardly toward one another. The sidewalls 34 have a bottom portion defining a throat 40 of the rail proximate the flanges 38. The throat 40 is located vertically where the sidewalls are closest together. The planar top portion 32 of the rail 14 has a plurality of spaced longitudinally extending slots 42 extending through the top portion 32 at the desired locations of the spring module 16. Each of the slots 42 has a generally rectangular middle portion 44 as best seen in FIG. 5 of a width W1 and two closed end portions 46 which may be of width W1 or may be of a width W2 which is less than the width W1.

As best illustrated in FIG. 2, each of the spring modules 16 comprises an upright yieldable portion 48 which typically includes two legs 50 but may take on a number of different configurations other than the one illustrated. The spring module 16 also has an upper portion 52 located in the top plane 54 of the spring assembly. The upper portion 52 of the spring module 16 may be secured to the deck 18 in any different number of ways. The spring module 16 further comprises a mounting foot 56 which is generally vertically oriented and insertable into one of the slots 42 of the rail 14.

Figure 4:
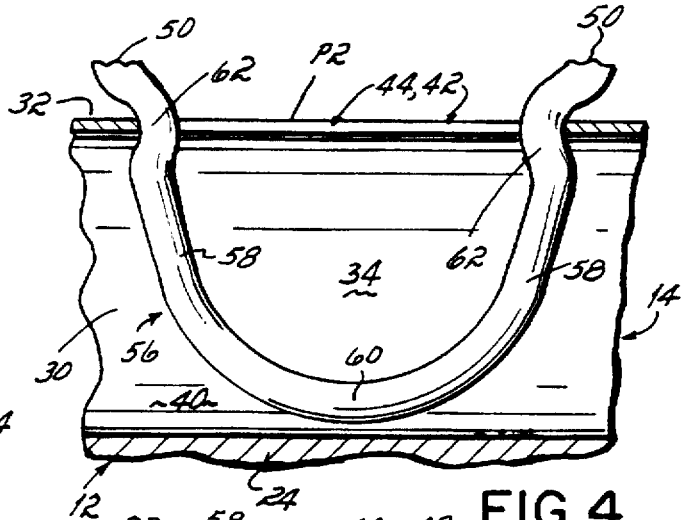
FIG. 4 is a cross-sectional view taken along the lines 4—4 of FIG. 3.

As best illustrated in FIG. 4, the mounting foot 56 of the spring module 16 of FIG. 2 is located at the lower end of the upright yieldable portion 48 of the spring module 16 and comprises two spaced leg portions 58 joined together by a connecting portion 60 urging the leg portions 58 apart. At the upper end of each leg portion 58 is located an inwardly curved notch or detent 62 adapted to engage one of the closed end portions 46 of the slots 42. As best illustrated in FIG. 2, when the mounting foot 56 is inserted into a slot 42 in the planar top portion 32 of the rail 14, the spring module 16 is pressed downwardly until the notches 62 in the leg portions 58 of the mounting foot 56 engage the closed end portions 46 of the slot 42 securing the spring module to the rail in a snap fit locked position.

As best illustrated in FIGS. 3 and 9, the sidewalls 34 of the rail of the present invention approach one another proximate the outwardly extending flanges 38 of the rail and define a throat 40 of the rail 14. The throat 40 is sized so as to engage in an interference fit the connecting portion 60 of the mounting foot 56 when the mounting foot 56 is inserted and snapped into a locked position inside the interior 30 of the rail 14. The engagement of the throat 40 of the rail 14 with the lowermost connecting portion 60 of the mounting foot 56 prevents the spring module 16 as a whole from pivoting about the plane P2 defined by the top portion 32 of the rail 14 and holds the mounting foot 56 relatively stationary in a vertically oriented position as illustrated in FIG. 3. With the configuration of the rails of the present invention, the spring module is inhibited from moving and causes a better, more secure connection between the rail and the spring module without permanently securing the spring module to the rail.

In order to insert the spring module of the present invention into the rail of the present invention, the two legs 50 of the upright yieldable portion 48 of the spring module 16 may be pushed together and the mounting foot 56 of the spring module 16 lowered into the middle portion 44 of a slot 42. The spring module 16 may be further lowered until the connecting portion 60 of the mounting foot 56 engages the throat 40 of the rail 14 and the notches 62 of the leg portions 58 snap into and engage the closed end portions 46 of the slot 42. At this point, the compression of the two legs 50 of the upright yieldable portion 48 is released causing the mounting foot 56 to snap into a locked position inside the interior 30 of the rail as illustrated in FIGS. 2 and 3. In order to remove the spring module 16 from the rail 14, the two legs 50 of the module may again be compressed and the spring module 16 pulled upwardly until the mounting foot 56 is above the rail.

The preferable method of assembling the bedding foundation 10 of the present invention is to first secure the upper portion 52 of the upright yieldable portion 48 of each spring module 16 to the deck 18 before securing the rails 14 to the mounting foot or mounting feet 56 of the spring modules 16. One method of attaching the rails 14 to the spring modules 16 is to place the combination of the assembled deck 18 and attached spring modules 16 (which when combined form an upper unit) upside down on a table so that the deck 18 lays flat against the table and the mounting feet 56 of the spring modules 16 are located above the deck. With the spring modules in this position, the rails are then aligned above the deck and spring modules 16 with the mounting feet 56 of the spring modules 16 directly below the slots 42 in the rails. The rails 14 are then moved downwardly until the U or V-shape of the mounting feet 56 of the spring modules 16 pass through the slots 42 in the rails 14 flex inward or cam into the slots, and the detents or notches 62 in the mounting feet 56 of the spring modules 16 snap into and engage the closed-end portions 46 of the slots 42 of the rails 14, thus securing the rails 14 to the spring modules 16. Once the mounting feet of the spring modules are snapped into place the frame 12 is secured to the rails 14.

Figure 6:
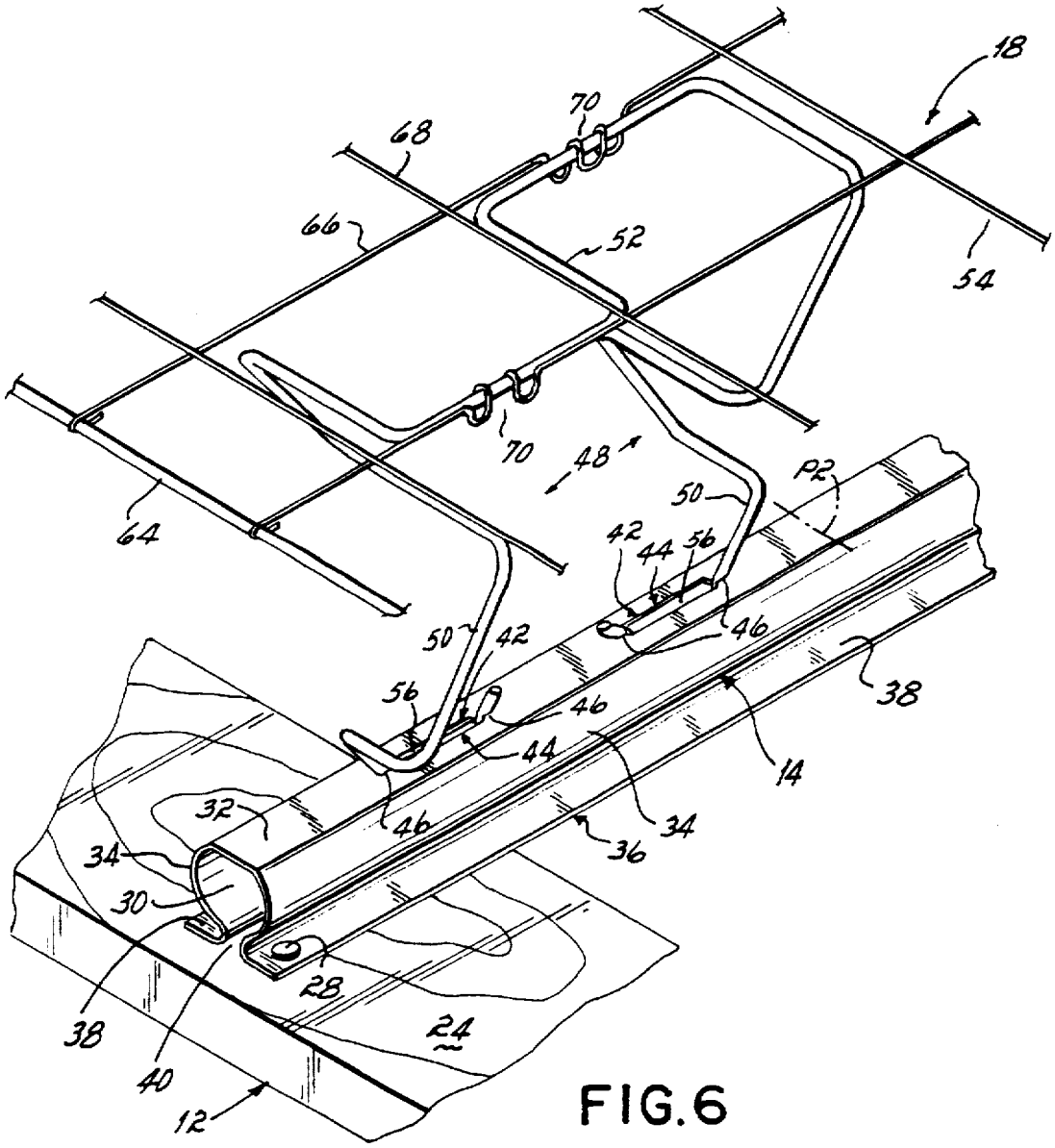
FIG. 6 is a perspective view of the rail of the present invention secured to a frame member and a spring module having two vertically oriented mounting feet secured to the rail.

As illustrated in FIG. 6, the spring module 16 of the present invention is not limited to having one vertically oriented mounting foot. The spring module 16 may have two vertically oriented mounting feet as illustrated in FIG. 6. The two mounting feet 56 of the spring module 16 of FIG. 6 are locked into two spaced apart slots 42 of a rail 14 in the same manner as a spring module having one mounting foot would be inserted into the rail of the present invention as described hereinabove. Like the spring module of FIG. 2, the spring module 16 of FIG. 6 would also have an upright yieldable portion 48 and an upper portion 52 secured to a deck 18.

Figure 7:
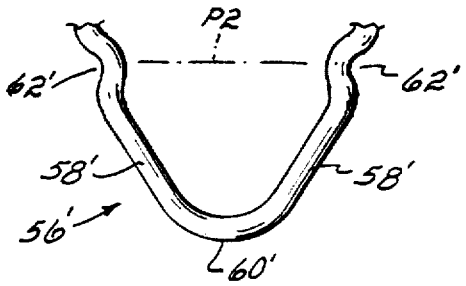
FIG. 7 is an alternative embodiment of a mounting foot of a spring module of the present invention.
Figure 8:
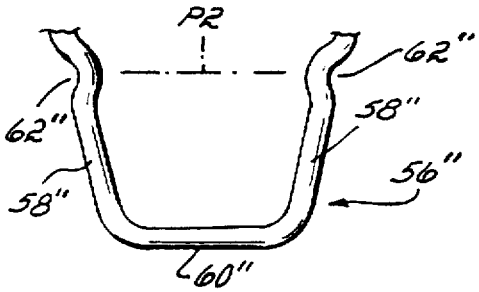
FIG. 8 is another alternative embodiment of a mounting foot of the present invention utilized in a spring module.
Figure 9A:
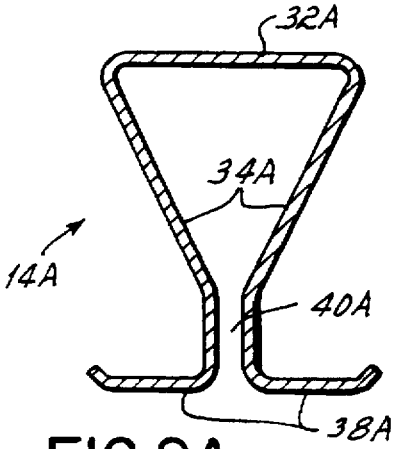
FIGS. 9A–9E are cross-sectional views of alternative embodiments of the rail of the present invention.
Figure 9B:
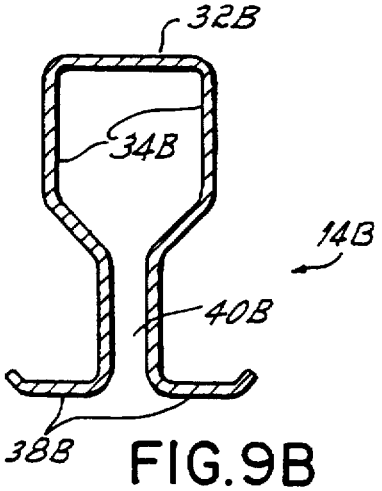
Figure 9C:
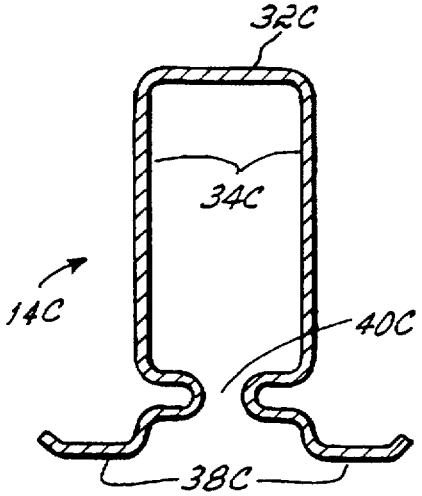
Figure 9D:
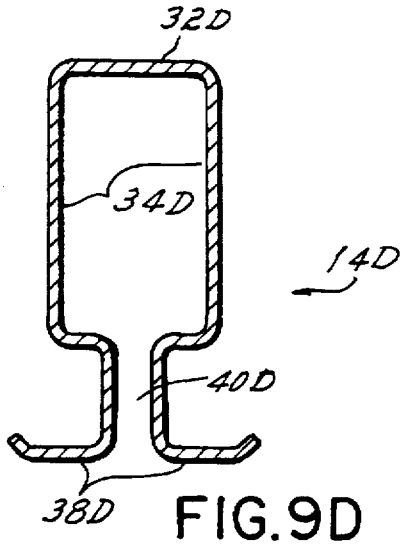
Figure 9E:
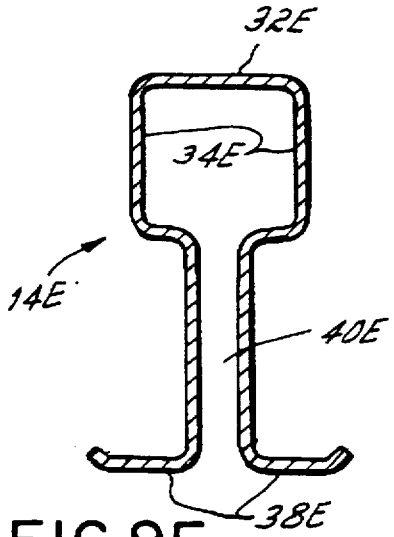

FIGS. 7 and 8 illustrate alternative embodiments of the mounting foot of the present invention. The mounting foot 56' of FIG. 7 has a narrower connecting portion 60' than the mounting foot 56 illustrated in FIG. 4 and is substantially V-shaped rather than the U-shaped. The mounting foot 56' of FIG. 7 also has two spaced leg portions 58' connected by a connecting portion 60' urging the leg portions 58' apart. Like the mounting foot 56 of FIG. 4, each leg portion 58' has a notch 62' at the upper end thereof.

Likewise, the mounting foot 56" of FIG. 8 comprises two leg portions 58" joined together by a connection portion 60". However, the connection portion 60" of the mounting foot 56" of FIG. 8 is relatively horizontal as opposed to the arcuate connecting portion 60 of the mounting foot of FIG. 4. Although the two alternative configurations of mounting feet of FIGS. 7 and 8 are illustrated as alternatives to the generally U-shaped mounting foot of FIG. 4, the mounting foot of the present invention may take on alternative configurations not illustrated as long as the mounting foot comprises two opposed leg portions each having a notch at the upper end thereof for engaging the closed end portions of a slot and the height between the notches and the lowermost connecting portion of the mounting foot does not exceed the height of the rail.

As best illustrated in FIGS. 2 and 6, a deck 18 is spaced a fixed distance above the frame 12 and rails 14 by a plurality of spring modules 16. The deck 18 comprises a grid like structure comprising a generally rectangular border wire 64 and a plurality of spaced parallel longitudinal members 66 and a plurality of spaced parallel transverse members 68. The ends of the longitudinal and transverse members 66, 68 are secured to the border wire 64 by being looped around the border wire 64 or secured in any other conventional fashion such as by welding or by sheet metal clips. Likewise, the transverse and longitudinal members 66, 68 may be welded to each other at their points of intersection.

As illustrated in FIGS. 2 and 6, the longitudinal members 66 of the deck 18 may have crimps 70 therein securing the upper portion 52 of the spring modules 16 to the deck 18. Any other securement device may likewise be utilized to secure the deck to the upper portions 52 of the spring modules 16 such as clips or welds. Likewise, the upper portions 52 of the spring modules 16 themselves may be crimped and the longitudinal members 66 of the deck 18 straight and uncrimped.

FIGS. 9A–9E illustrate cross-sectional views of alternative embodiments of the rail 14 of the present invention. All of the embodiments 14A–14E are identified by a letter; suffix A–E corresponding to FIGS. 9A–9E respectively and their individual portions are identified in like manner. Each rail 14A–14E illustrates a horizontal top portion 32A–32E and two opposed sidewalls 34A–34E extending downwardly from the outer edges of the horizontal top portion 32A–E of the rail. The sidewalls 34A may converge inwardly gradually as in FIG. 9A toward a throat 40A proximate the flanges 38A of the rail 14A located at the lowermost portion of the rail. Alternatively, as illustrated in FIGS. 9B–9E, the sidewalls 34B–E may extend vertically downwardly for a distance before converging inwardly to define a throat 40B–E proximate the lower flanges 38B–E of the rail. FIGS. 9A–9E illustrate several alternative embodiments of the present invention but additional embodiments of the rail not illustrated may also be included within the scope of the present invention.

While I have described several preferred embodiments of the present invention, persons skilled in the art will appreciate changes and modifications which may be made without departing from the spirit of the invention. Therefore, I do not intend to be limited except by the scope of the following appended claims.

What is claimed is:

1. A bedding foundation comprising:

a frame including at least one frame rail member, said rail member having a horizontal top portion, two opposed sidewalls extending downwardly from said top portion and planar flanges extending outwardly from the bottom of said sidewalls, each of said sidewalls having a bottom portion defining a lower throat between them, said top portion having at least one slot therethrough, at least one wire spring module having an upright yieldable portion supported on said at least one rail member by a generally vertically oriented U-shaped mounting foot at the lower end of said upright portion, said foot being insertable within said slot, said foot comprising a pair of spaced leg portions joined together by a connecting portion urging said leg portions apart, each leg portion having a notch therein for engaging said slot to retain said foot in said slot and said throat defined between said sidewalls being sized so as to engage said connecting portion of said foot and prevent lateral movement of said foot, an upper deck secured to said at least one spring module, padding overlying said deck, an upholstered covering enclosing said padding, said frame and said at least one spring module.

2. A spring assembly comprising:

a frame including at least one frame rail member, said rail member having a horizontal top portion, two opposed sidewalls extending downwardly from said top portion and each of said sidewalls having a bottom portion defining a lower throat between them, said top portion having at least one slot therethrough, at least one wire spring module having an upright yieldable portion supported on said at least one rail member by a generally vertically oriented U-shaped mounting foot at the lower end of said upright portion, said foot being insertable within said slot, said foot comprising a pair of spaced leg portions joined together by a connecting portion urging said leg portions apart, each leg portion having a notch therein for engaging said slot to retain said foot in said slot and said throat defined between said sidewalls being sized so as to engage said connecting portion of said foot and prevent lateral movement of said foot.

3. The spring assembly of claim 2 further comprising an upper deck secured to said upright yieldable portion of said at least one spring module.

4. The spring assembly of claim 2 wherein said at least one slot extends longitudinally along said rail member.

5. The spring assembly of claim 2 wherein said at least one slot has two closed end portions, said closed end portions of said at least one slot are of a width narrower than the width of the remainder of said at least one slot in order to better retain said foot in said slot.

6. The spring assembly of claim 2 wherein said two opposed sidewalls of said rail member are outwardly bowed.

7. The spring assembly of claim 2 wherein said rail member has planar flanges extending outwardly from the bottom of said sidewalls.

8. A spring assembly comprising:

a frame, a plurality of spaced, parallel rails secured to said frame, each of said rails having a generally hollow interior and comprising a generally horizontal top portion, two sidewalls extending downwardly from said top portion and two flanges extending outwardly from a bottom portion of said sidewalls, said sidewalls defining a throat proximate said flanges, said top portion having a plurality of slots therethrough, at spaced locations along said rail, a plurality of spring modules secured to said rails at said spaced locations along said rails, each of said spring modules having an upright yieldable portion and at least one vertically oriented mounting foot at the lower end of said upright portion, each foot being insertable within a slot of a rail, each foot comprising two opposed leg portions joined together by a connecting portion urging said leg portions-apart, each leg portion having an inwardly curved detent therein for engaging said slot to retain said foot in said slot, said throat defined between said sidewalls being sized so as to engage said foot in order to inhibit lateral movement of said foot.

9. The spring assembly of claim 8 wherein said sidewalls are closest together at said throat.

10. The spring assembly of claim 8 wherein said rails are metallic.

11. The spring assembly of claim 8 wherein each of said slots comprises a middle portion and two closed end portions at opposed ends of the slot, each of said closed end portions being of a width narrower than the width of said middle portion of said slot.

12. The spring assembly of claim 8 wherein said foot is generally U-shaped.

13. The spring assembly of claim 8 wherein said foot is generally V-shaped.

14. A spring assembly comprising:

a generally rectangular frame, a plurality of spaced, parallel metallic rails secured to said frame, each of said rails having a generally hollow interior and comprising a horizontal top portion, two sidewalls extending downwardly to a throat and a bottom portion comprising substantially planar outwardly extending flanges, said top portion having a plurality of spaced slots therein, a plurality of spring modules, each of said spring modules having an upright yieldable portion supported on a rail by at least one vertically oriented lowermost mounting foot, each mounting foot comprising two leg portions joined together by a connecting portion urging said leg portions apart from one another, each leg portion having a notch proximate said upright yieldable portion, said mounting foot being engagable with one of said slots in said rail to retain said mounting foot in said slot and said throat defined by said rail sidewalls being engagable with said connecting portion of said mounting foot to inhibit lateral movement of said mounting foot inside said rail.

15. The spring assembly of claim 14 wherein each of said slots comprises a middle portion and closed end portions at opposed ends of the slot, each of said closed end portions being of a width narrower than the width of said middle portion of said slot.

16. The spring assembly of claim 15 wherein the notches of said mounting foot are snapped into a locked position inside said closed end portions of said slot.

17. The spring assembly of claim 14 wherein said foot is generally U-shaped.

18. The spring assembly of claim 14 wherein said foot is generally V-shaped.

19. A method of securing a spring module to a rail comprising:

providing a rail having a generally horizontal top portion, a bottom portion and two sidewalls, said sidewalls approaching each other and defining a throat of said rail proximate the bottom portion of said rail, said top portion having at least one longitudinally extending slot therethrough, said slot having a middle portion and two closed end portions, providing a spring module having at least one generally vertically oriented lowermost mounting foot, said foot comprising two upwardly extending leg portions joined together by a connecting portion urging said leg portions apart, each leg portion having a notch at an upper end of said leg portion, passing said foot downwardly through said slot until said connecting portion of said foot contacts said throat of said rail and said notches of said leg portions engage said closed end portions of said slot, thereby locking said foot of said spring module inside the interior of said rail.

20. A method of constructing a spring assembly comprising:

providing a frame, securing a plurality of parallel rails to said frame, each rail having a generally horizontal top portion, a bottom portion and two sidewalls, said sidewalls approaching each other and defining a throat of said rail proximate the bottom portion of said rail, said top portion having multiple longitudinally extending slots therethrough, each slot having a middle portion and two closed end portions of a narrower width than the middle portion of said slot, providing a plurality of spring modules, each spring module having at least one generally vertically oriented lowermost mounting foot, each mounting foot comprising two leg portions joined together by a connecting portion, each leg portion having a notch at an upper end of said leg portion, passing said at least one foot of said spring module downwardly through on of said slots until said connecting portion of said foot contacts said throat of said rail and said notches of said leg portion snaps into said closed end portions of said slots, thereby locking said foot to said rail.

21. The method of claim 20 further comprising the step of securing an upper deck to said spring module.

22. A method of constructing a spring assembly comprising:

providing an upper deck of wire members, securing a plurality of spring modules to said upper deck to form an upper unit, each spring module having an upright yieldable portion and at least one generally vertically oriented lowermost mounting foot, each mounting foot comprising two leg portions joined together by a connecting portion, each leg portion having a notch at the upper end of said leg portion, inverting said upper unit such that said upper deck is supported on a horizontal surface and said at least one lowermost mounting foot of each spring module is located above said upright yieldable portion, providing a plurality of rails, each rail having a generally horizontal top portion, a bottom portion and two sidewalls, said sidewalls approaching each other and defining a throat of said rail proximate the bottom portion of said rail, said top portion having multiple longitudinally extending slots therethrough, pushing downwardly each of said rails causing said at least one mounting foot of each of said spring modules to pass through said slots of said rail until said connecting portion of said foot contacts said throat of said rail and said notches of said leg portions engage said slot, thereby locking said spring modules to said rail, and securing the bottom portion of said rails to a frame.

* * * * *